US006984148B1

(12) United States Patent
Nanda et al.

(10) Patent No.: US 6,984,148 B1
(45) Date of Patent: Jan. 10, 2006

(54) ELECTRICAL CONNECTOR APPARATUS AND COVER THEREFOR

(75) Inventors: Amar Kant Nanda, Surrey (CA); Mossadiq Umedaly, West Vancouver (CA)

(73) Assignee: Xantrex Technology Inc., Burnaby (CA)

( * ) Notice: Subject to any disclaimer, the term of this patent is extended or adjusted under 35 U.S.C. 154(b) by 0 days.

(21) Appl. No.: 10/892,212

(22) Filed: Jul. 16, 2004

(51) Int. Cl.
*H01R 13/73* (2006.01)

(52) U.S. Cl. ..... 439/564; 439/777; 439/521; 439/892; 439/908

(58) Field of Classification Search ..... 439/777, 439/521, 892, 908, 883, 801, 564, 573, 942, 439/719, 546, 547
See application file for complete search history.

(56) References Cited

U.S. PATENT DOCUMENTS

| | | | | | |
|---|---|---|---|---|---|
| 1,359,280 | A | | 11/1920 | Schwartz | |
| 2,174,382 | A | | 9/1939 | Elder et al. | |
| 3,340,497 | A | * | 9/1967 | Balint | 439/872 |
| 3,467,768 | A | * | 9/1969 | Shorey | 174/138 F |
| 3,717,805 | A | | 2/1973 | Gnaedinger et al. | |
| 3,960,427 | A | * | 6/1976 | Piaget et al. | 439/147 |
| 4,186,339 | A | | 1/1980 | Finger | |
| 4,231,631 | A | * | 11/1980 | Guerinault et al. | 439/559 |
| 4,337,374 | A | * | 6/1982 | Smith | 174/138 F |
| D283,221 | S | | 4/1986 | West | |
| 4,872,102 | A | | 10/1989 | Getter | |
| D310,320 | S | | 9/1990 | Domian | |
| 5,104,333 | A | * | 4/1992 | Hatagishi et al. | 439/342 |
| 5,133,668 | A | | 7/1992 | Brown, IV | |
| 5,145,404 | A | * | 9/1992 | Beattie et al. | 439/521 |
| 5,170,336 | A | | 12/1992 | Getter et al. | |
| 5,213,520 | A | * | 5/1993 | Casey et al. | 439/559 |
| 5,266,055 | A | | 11/1993 | Naito et al. | |
| 5,293,145 | A | | 3/1994 | Rynkiewicz | |
| 5,409,401 | A | | 4/1995 | Schaarschmidt et al. | |
| 5,488,352 | A | | 1/1996 | Jasper | |
| 5,600,550 | A | | 2/1997 | Cook, II | |
| 5,791,936 | A | * | 8/1998 | Nicholson | 439/521 |
| 5,906,495 | A | * | 5/1999 | Morgan | 439/92 |
| 6,042,431 | A | * | 3/2000 | Hayakawa | 439/801 |
| 6,068,513 | A | | 5/2000 | Cameron et al. | |
| 6,213,808 | B1 | * | 4/2001 | Whatmore et al. | 439/417 |
| 6,375,493 | B1 | * | 4/2002 | Lin | 439/457 |
| 6,709,287 | B2 | * | 3/2004 | Sims et al. | 439/559 |
| 2001/0003075 | A1 | * | 6/2001 | Nagayasu | 439/521 |

FOREIGN PATENT DOCUMENTS

| | | |
|---|---|---|
| CA | 2244470 | 2/1999 |

(Continued)

*Primary Examiner*—Tho D. Ta

(57) ABSTRACT

An electrical connector apparatus includes an electrically insulating base, and a conductor extending through the base. The conductor may include a first electrical terminal located on a first side of the base and a second electrical terminal located on a second side of the base. The apparatus further includes at least three spaced apart guides on the first side of the base, all of the spaced apart guides being adjacent the first electrical terminal and being operable to guide a wire terminated to the first electrical terminal to extend in any direction between two adjacent guides. A cover may be applied to the electrical connector, the cover including a housing including joined rigid wall portions configured to extend about a perimeter and over a top of an electrical terminal, at least one of the wall portions having a conductor opening. The cover apparatus further includes a conductor guard having a rigid guide wall extending from at least one of the wall portions, adjacent the conductor opening, to guard a wire terminated to the electrical terminal against small-radius bends near the electrical terminal.

39 Claims, 8 Drawing Sheets

FOREIGN PATENT DOCUMENTS

| | | | |
|---|---|---|---|
| EP | 0090774 | | 10/1983 |
| EP | 0 910 136 | A2 | 4/1999 |
| FR | 1198282 | | 12/1959 |
| GB | DES. 2022330 | | 9/1992 |
| GB | DES. 2022331 | | 9/1992 |
| GB | DES. 2046448 | | 8/1995 |
| GB | DES. 2059651 | | 5/1997 |
| WO | WO 02/13323 | A1 | 2/2002 |
| WO | WO 02/087022 | A1 | 10/2002 |
| WO | WO 03/043132 | A1 | 5/2003 |
| WO | WO 03/098752 | A1 | 11/2003 |

* cited by examiner

ELECTRICAL CONNECTOR APPARATUS AND COVER THEREFOR

BACKGROUND OF THE INVENTION

1. Field of Invention

This invention relates to electrical connector apparatus and covers therefor.

2. Description of Related Art

Methods for terminating an electrical conductor abound. One common method involves the use of a screw terminal. Various types of screw terminals exist including barrier-type screw terminals that employ a row of screw terminals each of which is separated from an adjacent one by a barrier. The barriers tend to define a particular direction in which a wire or crimp connector may be installed on the screw terminal. Typically they permit a crimp connector or wire to be installed in only two directions, each about 180 degrees apart from the other. This can be limiting, especially where high current DC cables, for example are to be connected to the screw terminal.

Lead acid-type batteries typically have terminals which may include a conductive disk with a threaded stud projecting therefrom. The stud however is susceptible to being broken off due to excessive tightening torque, requiring replacement of the terminal or replacement of the battery. Typically this type of terminal is molded into a battery casing and is not easily removed.

SUMMARY OF THE INVENTION

The present invention provides a way of fastening electrical conductors, particularly relatively high current electrical conductors to a device having an internal printed circuit board, without placing strain on the printed circuit board, while providing an easy way of mounting a connector to the device. The invention need not be employed in this specific application and may be used generally anywhere a connector is required to connect one wire to another, especially on a device, where the two wires may be on opposite sides of a wall, barrier or bulkhead of the device.

In accordance with one aspect of the invention, there is provided an electrical connector apparatus. The electrical connector apparatus includes an electrically insulating base, and a conductor extending through the base. The conductor may include a first electrical terminal located on a first side of the base and a second electrical terminal located on a second side of the base. The apparatus may further include at least three spaced apart guides on the first side of the base, all of the spaced apart guides being adjacent the first electrical terminal and being operable to guide a wire terminated to the first electrical terminal to extend in any direction between two adjacent guides.

The first and second sides of the base may be on opposite sides of the base. The first electrical terminal may include a first threaded opening in the conductor. The second electrical terminal may include a second threaded opening in the conductor. The first and second threaded openings may be coterminous and form a threaded passageway through the conductor. The first and second threaded openings may be coaxial. The base may be molded about the conductor.

The base may include a mounting portion. The mounting portion may include a flat surface on the second side of the base. The flat surface may have threaded inserts disposed therein, for receiving fasteners for fastening the base to a device. The base may include a projection extending from the flat surface. The flat surface may have threaded inserts disposed therein and symmetrically about the projection. The flat surface may have an o-ring groove extending around the projection for receiving an o-ring for sealing the connector against a mounting surface.

The base may include a stage portion on the first side of the base. The spaced apart guides may be disposed about the stage portion. The base may include bridging surface portions extending between the guides, adjacent the stage portion. The base may include a first opening in the stage portion that extends to a cavity in the base. The base may further include a second opening in a distal end of the projection extending to the cavity. The conductor may include a rotation preventer operable to prevent rotation of the conductor relative to the base. The rotation preventer may include a flat surface on the conductor. The rotation preventer may be in the cavity.

The conductor may have first and second end portions with first and second distal surfaces respectively, and a length, measured between the first and second distal surfaces, that is slightly longer than the bore such that the first and second end portions project slightly beyond the distal ends of the projection and the stage portion.

The conductor may have first and second coterminous openings in the first and second distal surfaces respectively, forming a passageway through the conductor. The first and second coterminous openings and the passageway may be coaxial.

The first and second coterminous openings and the passageway may be threaded for receiving first and second bolts in the first and second openings respectively, for securing connectors on respective wires to the first and second electrical terminals respectively.

The guides may have respective flat planar distal end surfaces and the flat planar distal end surfaces may be disposed at a distance from the stage portion. The flat planar distal end surfaces may be coplanar. The guides may have respective threaded inserts in respective flat planar distal end surfaces, the threaded inserts being operable to receive fasteners for fastening a cover to the base.

The apparatus may further include a cover apparatus including a housing including joined rigid wall portions configured to extend about a perimeter and over a top of an electrical terminal, at least one of the wall portions having a conductor opening, the cover apparatus further including a conductor guard comprising a rigid guide wall extending from at least one of the wall portions, adjacent the conductor opening, to guard a wire terminated to the electrical terminal against small-radius bends near the electrical terminal.

In accordance with another aspect of the invention, there is provided a cover apparatus for covering an electrical terminal. The cover apparatus includes a housing including joined rigid wall portions configured to extend about a perimeter and over a top of an electrical terminal, at least one of the wall portions having a conductor opening. The cover apparatus further includes a conductor guard having a rigid guide wall extending from at least one of the wall portions, adjacent the conductor opening, to guard a wire terminated to the electrical terminal against small-radius bends near the electrical terminal.

The rigid guide wall may have an outwardly flared shape.

The wall portions and the rigid guide wall may be embodied in a unitary piece of insulating material.

The insulating material may include plastic.

At least one of the wall portions may have a landing formed therein, the landing having an opening, for receiving a fastener for securing the cover to the electrical terminal.

At least one of the wall portions may be curved and may be configured to extend over the top portion of the electrical terminal.

At least one of the wall portions may be curved and may be positioned opposite the wall portion having a conductor opening.

The wall portion extending over the top portion of the electrical terminal and the wall portion positioned opposite the wall portion having the conductor opening may be joined by an angled wall portion.

At least one of the wall portions may have a test probe opening operable to receive a test probe to permit contacting the test probe with the electrical terminal without requiring removal of the cover from the electrical terminal.

At least one of the wall portions may be curved and may be configured to extend over the top portion of the electrical terminal and may have a test probe opening operable to receive a test probe to permit contacting the test probe with the electrical terminal without requiring removal of the cover from the electrical terminal.

The wall portions configured to extend about a perimeter the electrical terminal may have edges that lie in a common plane. The rigid guide wall may be generally U-shaped and may have first and second leg portions having edges lying in the common plane. The rigid guide wall may include a curved joining portion joining the first and second leg portions, the curved joining portion having a radius of curvature becoming progressively larger progressively farther away from the housing.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
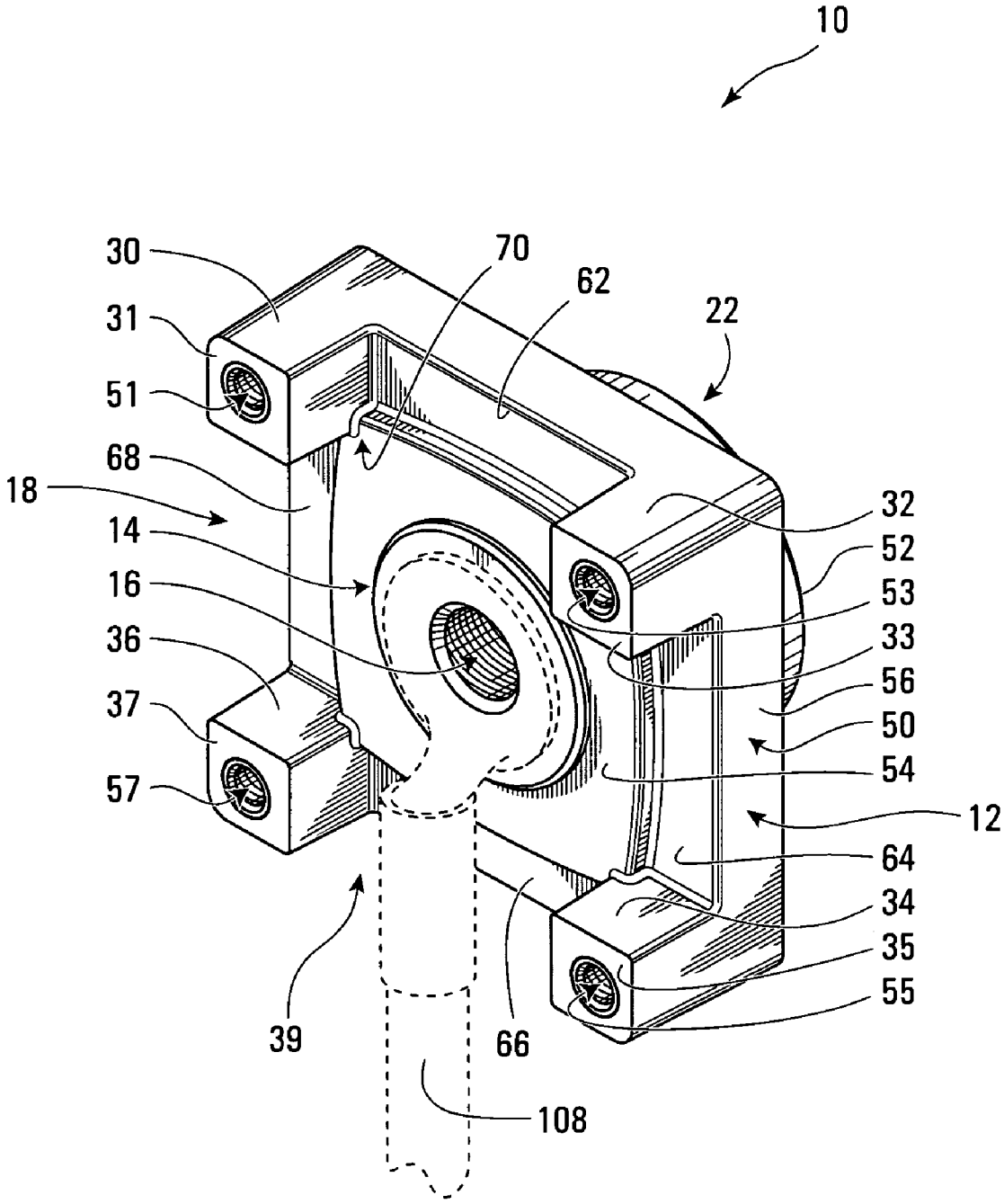
FIG. 1 is a perspective view of an electrical connector apparatus according to a first embodiment of the invention.
Figure 3:
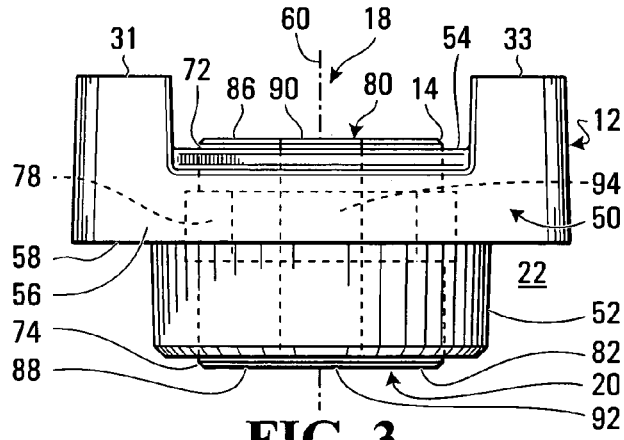
FIG. 3 is a top view of the electrical connector apparatus shown in FIG. 1.
Figure 4:
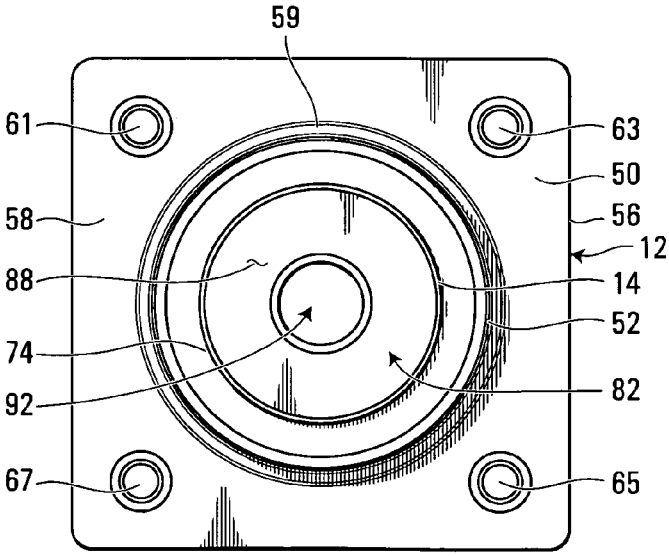
FIG. 4 is a side elevational view of a second side of the electrical connector apparatus shown in FIG. 1.

Referring to FIG. 1, an electrical connector apparatus according to a first embodiment of the invention is shown generally at 10. The apparatus includes an electrically insulating base 12, a conductor 14 extending through the base and having a first electrical terminal 16 located on a first side 18 of the base. Referring to FIG. 3, the conductor 14 further includes a second electrical terminal 20 located on a second side 22 of the base 12, opposite the first side 18.

Referring back to FIG. 1, the apparatus 10 includes at least three spaced apart guides on the first side of the base 12 and in the embodiment shown there are four spaced apart guides identified as first, second, third and fourth guides 30, 32, 34, and 36. All of the spaced apart guides 30, 32, 34, 36 are adjacent the first electrical terminal 16 and are operable to guide a wire 108 terminated to the first electrical terminal 16 to extend in a sector 39 between two adjacent guides. Each of the guides 30, 32, 34 and 36 has an outer, distal surface 31, 33, 35 and 37, and may be fitted with a respective threaded insert 51, 53, 55 and 57 in its respective distal surface. The guides confine the movement of the wire 108 connected to the first electrical terminal 16 to cause it to extend from the first electrical terminal in a direction defined between adjacent guides such as guides 34 and 36 as shown.

Figure 5:
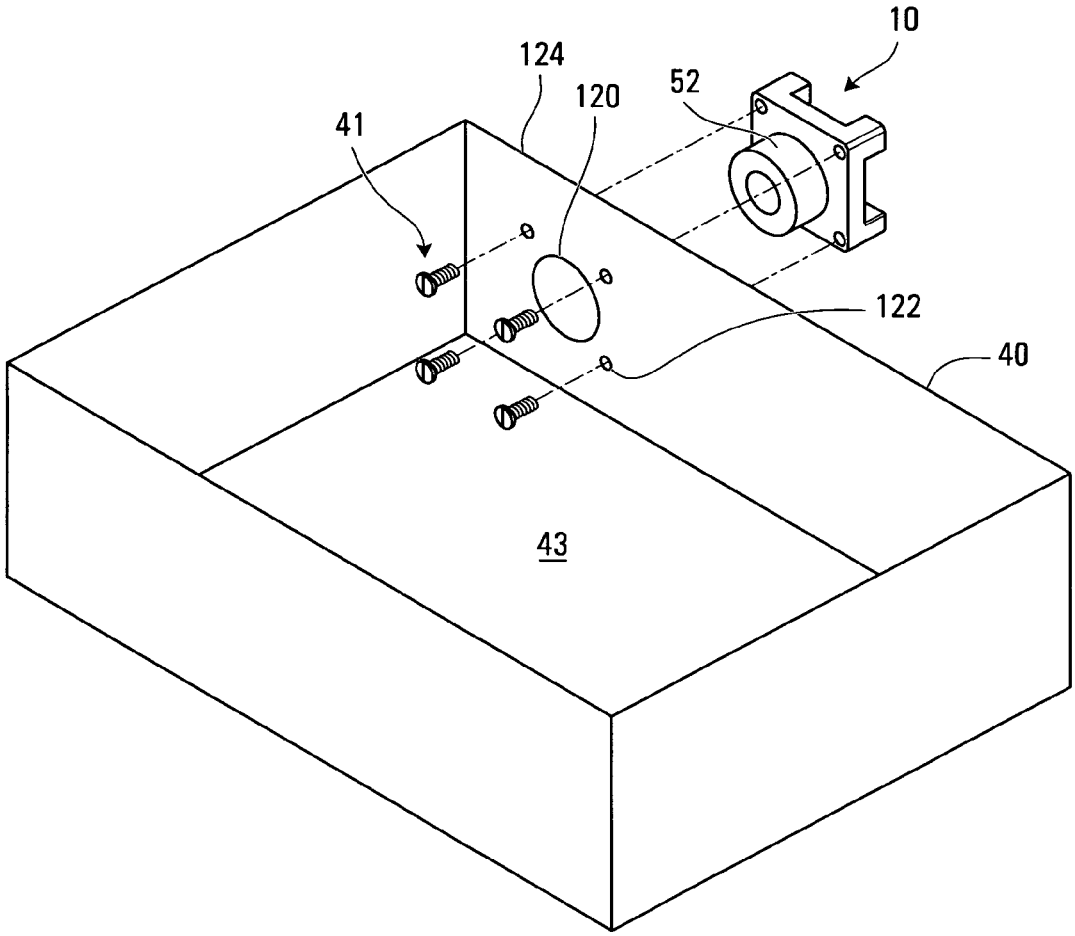
FIG. 5 is a perspective view of a device on which the electrical connector apparatus shown in FIG. 1 is to be installed.

Referring to FIG. 5, the apparatus 10 may be mounted to an outside of a device 40 such as an inverter, for example, with fasteners 41 for holding the apparatus 10 being installed from an inside area 43 of the device, so that the fasteners cannot be seen or accessed from the outside of the device.

Figure 2:
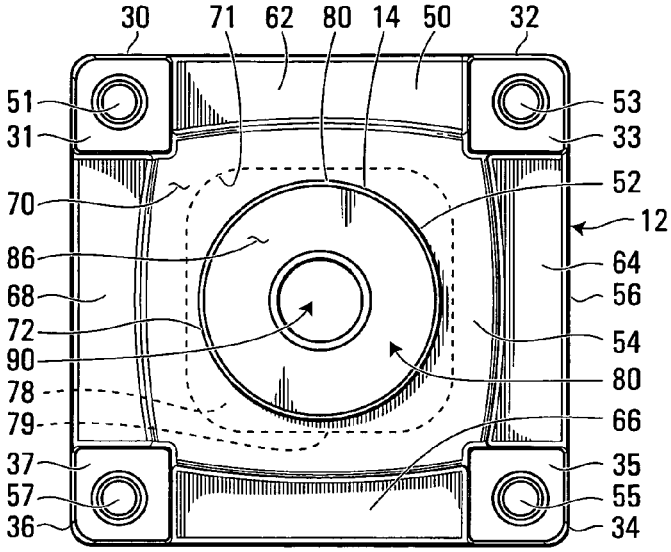
FIG. 2 is a plan view of a first side of the electrical connector apparatus shown in FIG. 1.

Referring to FIGS. 1–4, the base 12 further includes a mounting portion 50, a projection 52, and a raised stage portion 54 seen best in FIGS. 1–3. In the embodiment shown, the mounting portion 50 includes a wall 56 having a generally rectangular outer perimeter although the outer perimeter may be any suitable shape. The wall 56 defines the first and second opposite sides 18 and 22 of the base 12.

On the first side 18 of the base 12, the guides 30, 32, 34, 36 project from the wall 56 and the wall has generally coplanar bridging surface portions 62, 64, 66 and 68 that extend between successive guides. The raised stage portion 54 projects outwardly of the bridging surface portions 62, 64, 66 and 68 by about 1 mm and defines a relatively flat planar area 70 surrounded by the guides and bridging surface portions 62, 64, 66 and 68. A first cylindrical opening 72 is formed in the flat planar area 70 and extends in a first direction to a cavity 71. A second cylindrical opening 74 in a distal end 76 of the projection 52 extends in a second, opposite direction, into the cavity.

On the second side 22 of the base 12, the wall 56 has a first flat mounting surface 58 having a central axis 60. Threaded inserts 61, 63, 65 and 67 are installed symmetrically about the central axis 60 in the flat mounting surface 58. The projection 52 has a cylindrical shape and extends outwardly from the first flat mounting surface 58 and is centered on the central axis 60. The flat mounting surface 58 has an o-ring groove 59 therein for receiving an o-ring for sealing the connector against a mounting surface of a device such as device 40.

In the embodiment shown, the conductor 14 is provided by a brass member that extends through the base 12, from the first side 18 to the second side 22. The conductor 14 has a section 78 having a rotation preventer, which in the embodiment shown includes at least one flat surface 79 that is received in the cavity 71 to hold it against rotation relative to the base 12. The conductor 14 also has first and second end portions 80 and 82 extending in opposite directions from the section 78. In the embodiment shown, the section 78 has a flat surface 79 to prevent relative rotation between the conductor 14 and the base 12. In general, any method of preventing such relative rotation would work, including simple projections extending from the conductor 14 into the base 12 or flat surfaces on portions of the end portions 80 and 82 that are embedded within the base, for example. It will be appreciated that the cavity 71 and openings 72 and 74 need not be pre-formed in the base 12, but rather may be formed by molding the base around the conductor 14. Pre-forming of the cavity 71 and openings 72 and 74 may be required where the base is formed in two halves that are joined together about the conductor 14, for example.

Figure 6:
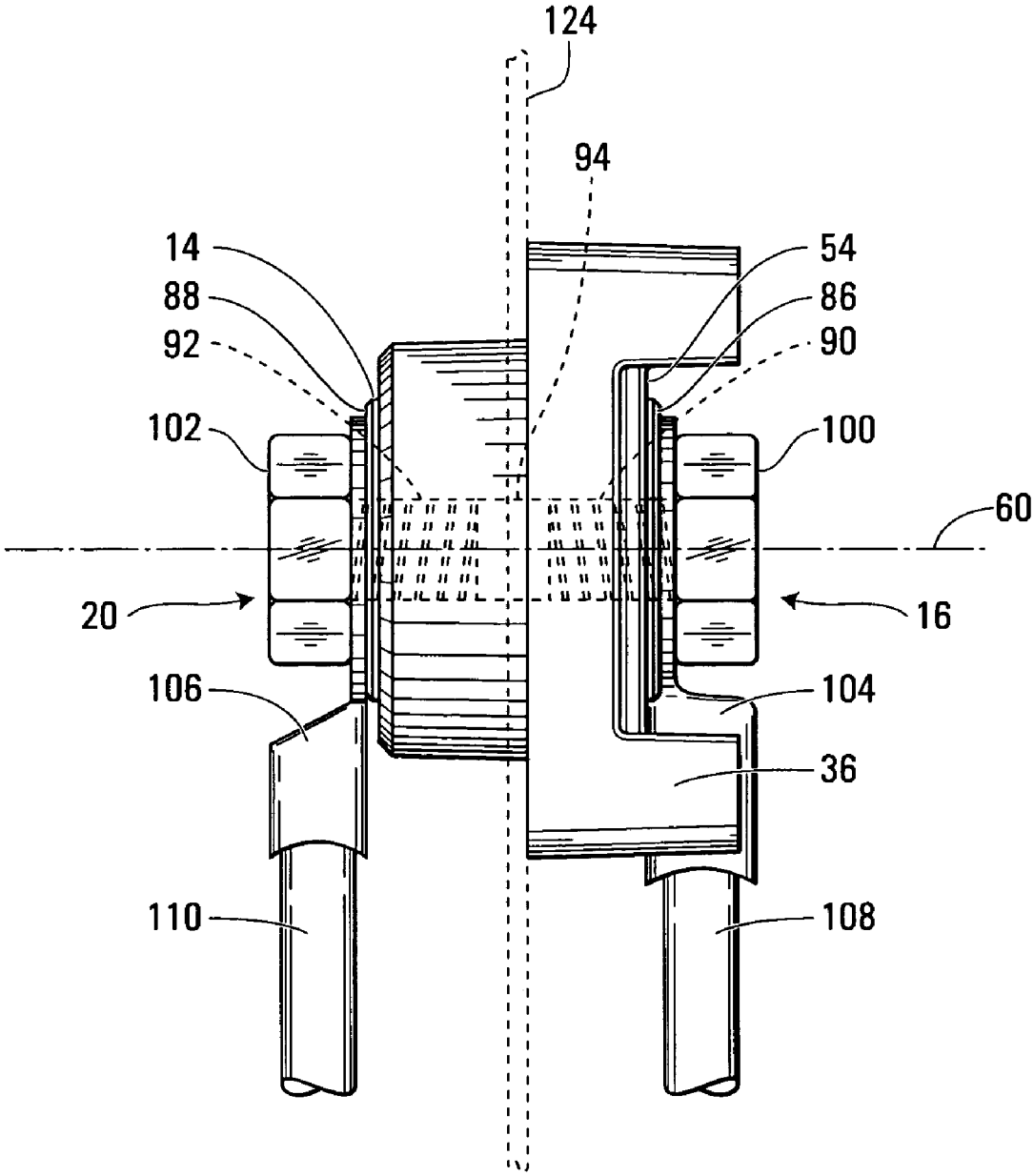
FIG. 6 is a side view of the electrical connector apparatus shown in FIG. 1, shown mounted on a wall of the device shown in FIG. 5.

The first and second end portions 80 and 82 of the conductor 14 are dimensional to project slightly beyond a distal surface of the raised stage portion 54 and a distal surface of the projection 52. The first and second end portions 80 and 82 have first and second generally flat distal surfaces 86 and 88 respectively. In the embodiment shown the first and second generally flat distal surfaces 86 and 88 have first and second coterminous, coaxial openings 90 and 92 respectively forming a passageway 94 formed along an axis of symmetry 96 of the conductor 14 coincident with the central axis 60. Referring to FIG. 6, in the embodiment shown, the first and second openings 90 and 92 and passageway 94 are threaded for receiving first and second bolts 100 and 102 in the first and second openings 90 and 92 respectively, for securing crimp connectors 104 and 106, to which respective external and internal wires 108 and 110 may be attached to the opposite ends of the conductor 14. The first and second openings 90 and 92 and surrounding first and second generally flat distal surfaces 86 and 88 respectively act as the first and second electrical terminals 16 and 20 respectively.

Referring to FIG. 5, in use, a device 40 on which the apparatus 10 is to be used is configured to include a circular opening 120 having a diameter slightly larger than the diameter of the projection 52. Additional openings such as opening 122 are formed in a wall 124 of the device 40 to facilitate receiving fasteners 41 such as screws therein to permit the fasteners 41 to engage with the threaded inserts 61, 63, 65 and 67 in the mounting surface 58. The apparatus 10 is mounted to the device 40 such that the projection 52 projects inwardly into the device through the opening 120 and such that the fasteners 41 are inserted into the openings 122 from inside the device 40. This ensures that the apparatus cannot be easily removed from the device 40 without opening it up. Referring to FIG. 6, when the apparatus 10 is mounted to the device 40, the o-ring 71 seals the connector against the wall 124 of the device, thus making the device usable for both indoor and outdoor applications. A wire 110 internal to the device, from a circuit such as an inverter circuit inside the device may be connected to the second electrical terminal 20 by engagement of the second bolt 102 with a ring of a crimp connector 106 on the wire and by engagement of the second bolt 102 with the threads in the second opening 92. The conductor 14 is thus electrically connected to the wire 110.

The guides 30, 32, 34 and 36 project outwardly, generally normal to the surface of the wall 124 of the device 40. An external wire 108, such as from a battery, for example, may be connected to the first electrical terminal 16 by engagement of the first bolt 100 with a ring of a first crimp connector 104 on the external wire 108 and engaging the threads on the first bolt with the threads in the first opening 90. The external wire 108 is thus electrically connected to the first electrical terminal 16 and is connected to the first terminal through the conductor 14. As the first bolt 100 is tightened in the first opening 90, the high torque forces involved as the bolt is tightened may have a tendency to rotate the crimp connector 104 about the central axis 60. The guides adjacent the crimp connector 104, only one of which is shown at 36 in FIG. 6, limit the range of rotation of the crimp connector to only a small sector, thus permitting the external wire 108 to extend from the connector generally radially, in a generally well-defined direction. The raised stage portion 54 and protruding generally flat distal surface 86 of the conductor 14 ensure a good, maximum surface area contact between the crimp connector 104 and the protruding generally flat distal surface 86 and provide clearance between the crimp connector 104 and the bridging surface portions 62, 64, 66 and 68 to avoid deforming the crimp connector 104 when the first bolt 100 is fully tightened in the first opening 90. A similar advantage is achieved at the second electrical terminal 20 due to the second end portion 82 of the conductor 14 projecting slightly beyond the end of the projection 52.

Additional wires may be connected to the first electrical terminal 16 by overlaying crimp connectors connected to respective such wires so that respective rings of the crimp connectors are axially aligned to receive the first bolt 100, and by securing the bolt with the crimp connectors thereon to the first opening 90. Respective wires may be arranged to extend between respective pairs of guides 30, 32, 34 and 36 such that each wire extends generally radially from the opening in a sector determined by the spacing of the respective pair of guides and the width (diameter) of the crimp portion of the respective crimp connector.

Figure 7:
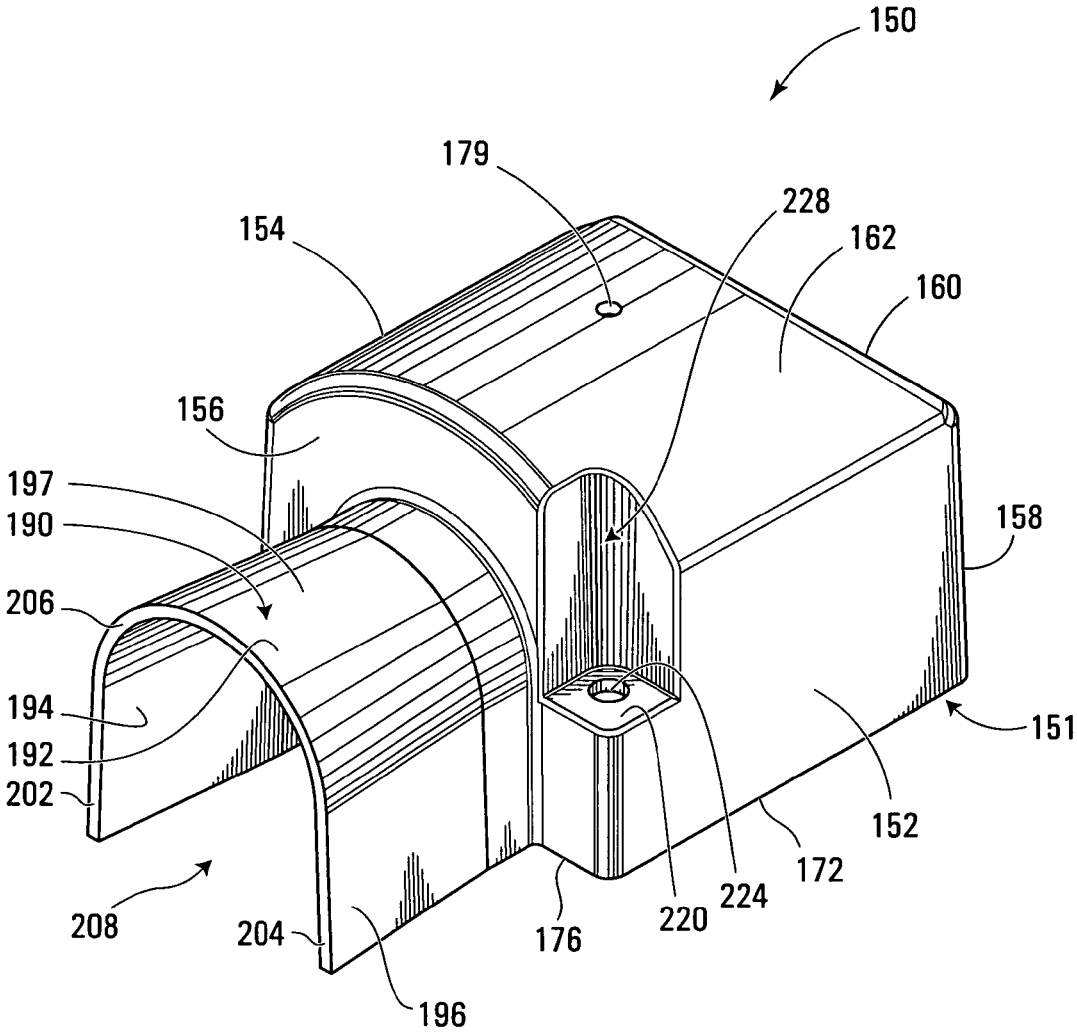
FIG. 7 is a perspective view of a cover apparatus according to another embodiment of the invention.
Figure 8:
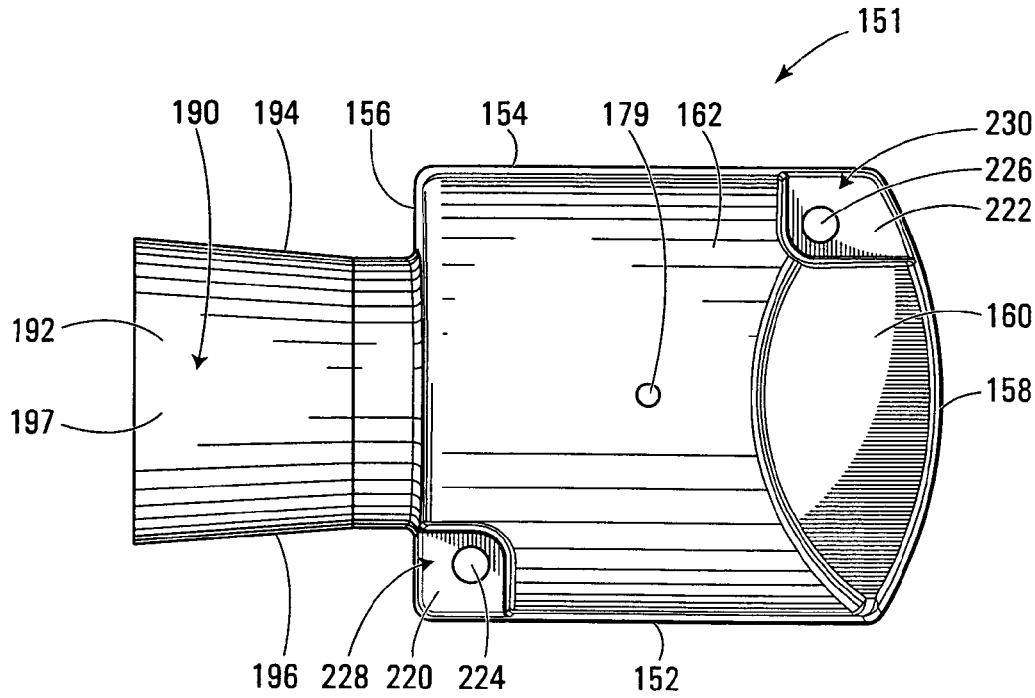
FIG. 8 is a top view of the cover apparatus shown in FIG. 7.
Figure 9:
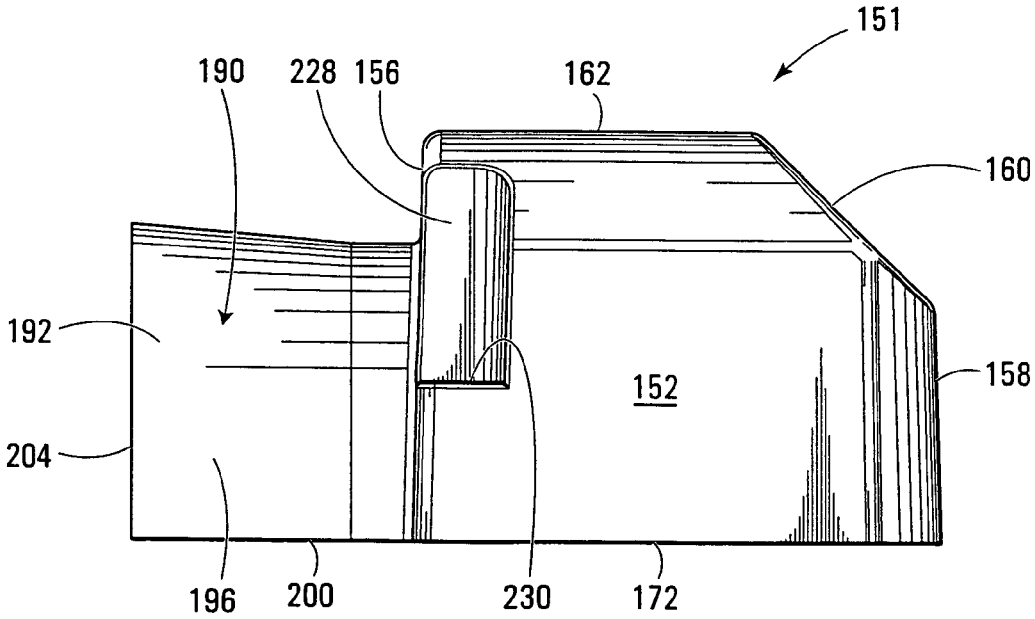
FIG. 9 is a first side view of the cover apparatus shown in FIG. 7.
Figure 10:
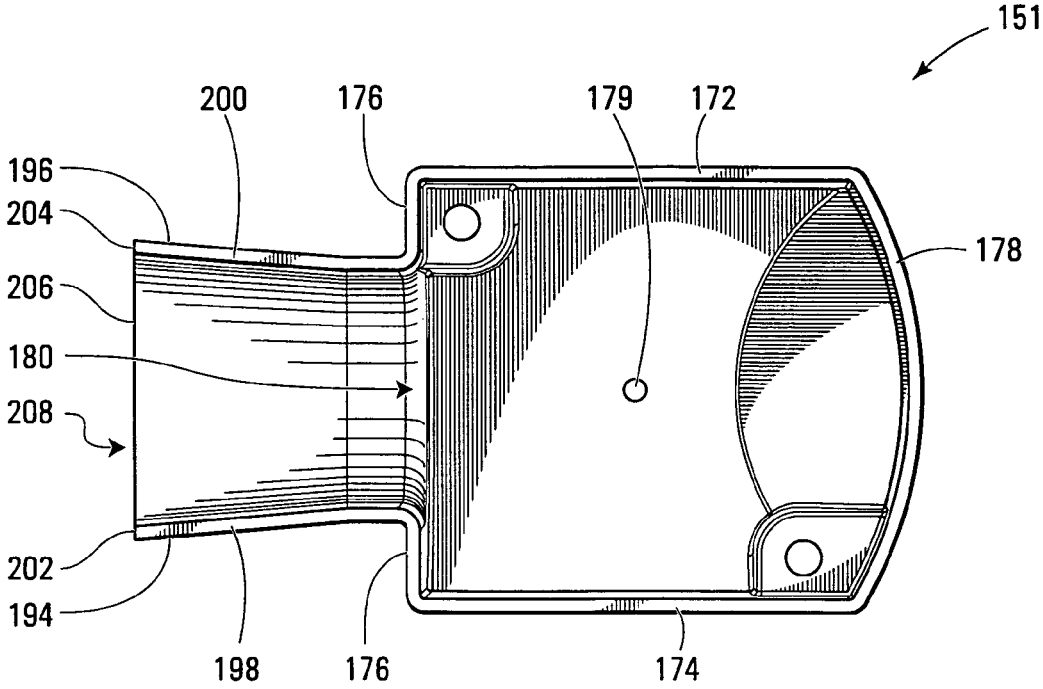
FIG. 10 is a bottom view of the cover apparatus shown in FIG. 7.
Figure 11:
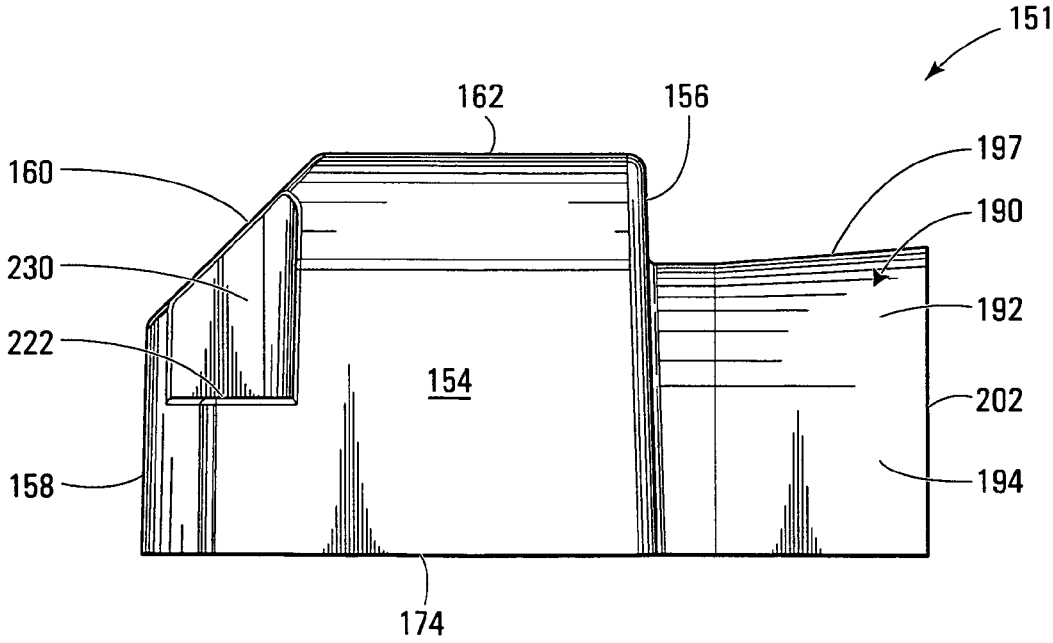
FIG. 11 is a second side view of the cover apparatus shown in FIG. 7.
Figure 12:
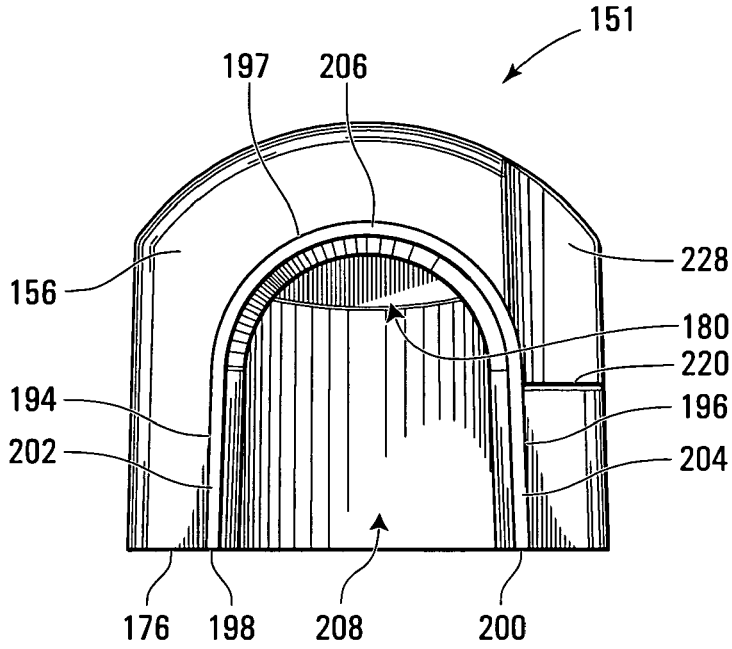
FIG. 12 is a front view of the cover apparatus shown in FIG. 7.
Figure 13:
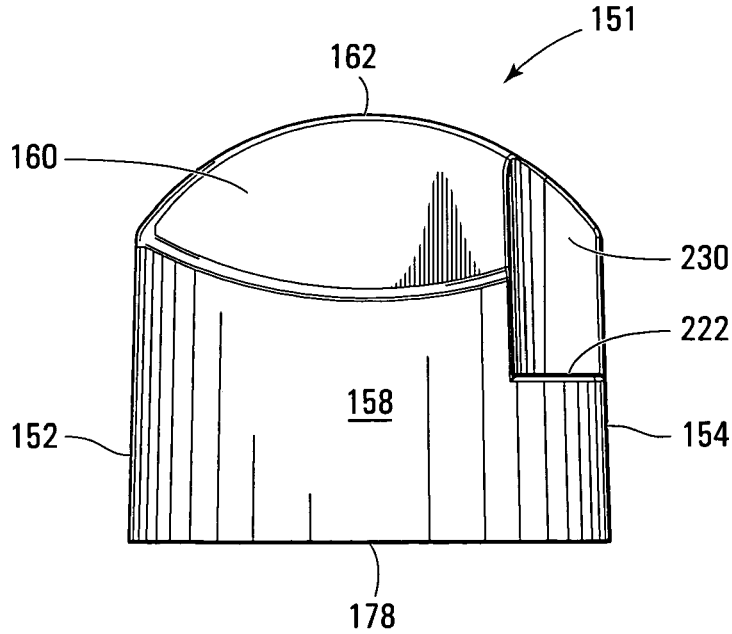
FIG. 13 is a rear view of the cover apparatus shown in FIG. 7.

Referring to FIG. 7, in accordance with another aspect of the invention, there is provided a cover apparatus 150, in accordance with one embodiment of the invention, for covering an electrical connector apparatus such as the one described above. In the embodiment shown the cover apparatus 150 includes a main housing 151 comprised of first 152, second 154, third 156, fourth 158, fifth 160 and sixth 162 joined rigid wall portions configured to extend about the perimeter and top of the base of the electrical connector apparatus 10 described above. The first, second, third and fourth wall portions 152, 154, 156 and 158 have respective edges 172, 174, 176 and 178 each having an edge surface lying in a common plane. In use, when the cover apparatus 150 is installed on the connector apparatus 10, the common plane would be coincident with a mounting surface on a wall such as wall 124 the device 40, or spaced apart slightly therefrom.

At least one of the wall portions has a conductor opening 180 and in the embodiment shown, the conductor opening is in the third wall portion 156. The cover apparatus 150 further includes a conductor guard 190 comprising a rigid guide wall 192 extending outwardly of the third wall portion 156, adjacent the conductor opening 180, to guard a wire terminated to the connector apparatus 10 described above against small-radius bends near the connector apparatus.

In the embodiment shown, the wall portions 152, 154, 156, 158, 160 and 162 and the rigid guide wall 192 are embodied in a unitary piece of electrically insulating material such as hard plastic.

The first and second side wall portions 152 and 154 are generally flat. The third wall portion 156 is generally flat with the rigid guide wall 192 extending therefrom. The fourth wall portion 158, disposed opposite the third wall portion 156 is convexly curved. Thus, the wall portion on a side of the cover opposite to the side from which the rigid guide wall extends is convexly curved.

The sixth wall portion 162 extending over the top portion of the electrical terminal is curved and joins the first, second and third side wall portions 152, 154 and 156. The fifth wall portion 160 extends between the fourth wall portion 158 and the fifth wall portion 160 and joins each of these wall portions such that it extends at an angle relative to the common plane in which the edges 172, 174, 176 and 178 lie.

At least one of the wall portions has a test probe opening 179 operable to receive a test probe to permit the test probe to contact the electrical terminal without requiring removal of the cover therefrom. In the embodiment shown, the test probe opening 179 is in the sixth wall portion 162.

In the embodiment shown, the rigid guide wall 192 is generally U-shaped having first and second leg portions 194 and 196 and a curved joining portion 197 joining the first and second leg portions 194 and 196. The first and second leg portions 194 and 196 are terminated in respective coplanar edges 198 and 200 that are coplanar with the edges 172, 174, 176, and 178 of the main housing 151. The first and second leg portions 194 and 196 also have distal portions 202 and 204 terminated in a single continuous distal edge 206 that defines an access opening 208 through which a wire connected to the connector apparatus 10 housed by the cover apparatus 150 may extend. The rigid guide wall 192 is configured such that the first and second leg portions 194 and 196 become progressively longer, progressively farther away from the third wall portion 156, and such that the radius of curvature of the joining portion 197 becomes progressively larger such that the access opening 208 is slightly larger than the conductor opening 180 in the third wall portion 156. The rigid guide wall 192 thus has an outwardly flared shape. This reduces any chance of cutting insulation on a wire extending into the housing due to rubbing of the insulation on the distal edge 206.

In the embodiment shown, the first and second wall portions 152 and 154 have first and second landings 220 and 222 formed at right angles therein, to align with corresponding fastener openings in an electrical connector with which the cover apparatus 150 is to be used. In the embodiment shown, the first and second landings 220 and 222 align with corresponding threaded inserts 51, 53, 55 and 57 in the guides 30, 32, 34 and 36 of the connector apparatus 10 described above. The landings 220 and 222 have first and second openings 224 and 226 respectively therein for receiving a fastener (not shown) for fastening the cover apparatus 150 to the connector apparatus 10. The sixth wall portion 162 has first and second recessed areas 228 and 230 adjacent the first and second landings 220 and 222 respectively, facilitating application of a tool such as a screw driver to fasteners received in the first and second openings 224 and 226. In the embodiment shown, the threaded inserts 51, 53, 55 and 57 in the guides 30, 32, 34 and 36 are arranged symmetrically at a common distance from the central axis 60. Similarly, the first and second landings 220 and 222 and first and second openings 224 and 226 are arranged symmetrically about an axis of the cover at distances similar to those of the threaded inserts. Consequently, the cover apparatus 150 may be placed on the connector apparatus 10 at one of four orientations, allowing the cover apparatus to permit a wire connected to the connector apparatus to extend in any of four directions from the connector apparatus. Similar symmetrical connector and cover arrangements could be made with other connectors having three or more guides and correspondingly shaped covers.

Different cover apparatuses of the type described may be colored red and black, for example and used on positive and negative terminals on the device 40, for example.

While specific embodiments of the invention have been described and illustrated, such embodiments should be considered illustrative of the invention only and not as limiting the invention as construed in accordance with the accompanying claims.

What is claimed is:

1. An electrical connector apparatus comprising:

an electrically insulating base;

a conductor extending through said base, said conductor comprising a first electrical terminal located on a first side of said base and a second electrical terminal located on a second side of said base, said first electrical terminal comprising a threaded opening in said conductor; and at least three spaced apart guides on said first side of said base, all of said spaced apart guides being adjacent said first electrical terminal and being operable to guide a wire terminated to said first electrical terminal to extend in any direction between two adjacent said guides.

2. The apparatus of claim 1 wherein said first and second sides of said base are on opposite sides of said base.

3. The apparatus of claim 1 wherein said guides have respective flat planar distal end surfaces.

4. The apparatus of claim 1 wherein said second electrical terminal comprises a second threaded opening in said conductor.

5. The apparatus of claim 4 wherein said first and second threaded openings are coterminous and form a threaded passageway through said conductor.

6. The apparatus of claim 4 wherein said first and second threaded openings are coaxial.

7. The apparatus of claim 6 wherein said base is molded about said conductor.

8. The apparatus of claim 1 wherein said base include a mounting portion.

9. The apparatus of claim 8 wherein said mounting portion includes a flat surface on said second side of said base.

10. The apparatus of claim 9 wherein said flat surface has threaded inserts disposed therein, for receiving fasteners for fastening said base to a device.

11. The apparatus of claim 9 wherein said base includes a projection extending from said flat surface.

12. The apparatus of claim 11 wherein said flat surface has threaded inserts disposed therein symmetrically about said projection.

13. The apparatus of claim 11 wherein said base includes a stage portion on said first side of said base.

14. The apparatus of claim 13 wherein said at least three spaced apart guides are disposed about said stage portion.

15. The apparatus of claim 13 wherein said base includes bridging surface portions extending between said guides, adjacent said stage portion.

16. The apparatus of claim 15 wherein said base includes a first opening in said staging portion that extends to a second coterminous opening in a distal end of said projection forming a bore extending through said base, said bore being operable to hold said conductor therein.

17. The apparatus of claim 16 wherein said conductor has first and second end portions with first and second distal surfaces respectively, and a length, measured between said first and second distal surfaces, that is slightly longer than said bore such that said first and second end portions project slightly beyond the distal end of said projection and the staging portion.

18. The apparatus of claim 17 wherein said first and second coterminous openings and said passageway are coaxial.

19. The apparatus of claim 17 wherein said conductor includes a rotation preventer operable to prevent rotation of the conductor relative to the base.

20. The apparatus of claim 19 wherein said rotation preventer includes a flat surface on said conductor.

21. The apparatus of claim 17 wherein said conductor has first and second coterminous openings in said first and second distal surfaces respectively, forming a passageway through said conductor.

22. The apparatus of claim 21 wherein said first and second coterminous openings and said passageway are threaded for receiving first and second bolts in said first and second openings respectively, for securing connectors on respective wires to said first and second electrical terminals respectively.

23. The apparatus of claim 11 wherein said flat surface has an o-ring groove therein, the o-ring groove extending around said projection.

24. The apparatus of claim 23 wherein said guides have respective flat planar distal end surfaces and wherein said flat planar distal end surfaces are disposed at a distance from said staging portion.

25. The apparatus of claim 24 wherein said flat planar distal end surfaces are coplanar.

26. The apparatus of claim 24 wherein said guides have respective threaded inserts in respective said flat planar distal end surfaces, said threaded inserts being operable to receive fasteners for fastening a cover to said base.

27. The apparatus of claim 1 further comprising a cover apparatus including a housing comprising joined rigid wall portions configured to extend about a perimeter and over a top of an electrical terminal, at least one of said wall portions having a conductor opening, and a conductor guard comprising a rigid guide wall extending from said at least one of said wall portions, adjacent said conductor opening, to guard a wire terminated to said electrical terminal against small-radius bends near said electrical terminal.

28. The apparatus of claim 27 wherein said rigid guide wall has an outwardly flared shape.

29. The apparatus of claim 27 wherein at least one of said wall portions has a landing formed therein, said landing having an opening, for receiving a fastener.

30. The apparatus of claim 27 wherein at least one of said wall portions has a test probe opening operable to receive a test probe to permit contacting the test probe with the electrical terminal without requiring removal of the cover from the electrical terminal.

31. The apparatus of claim 27 wherein at least one of said wall portions is curved and is configured to extend over said top portion of the electrical terminal and has a test probe opening operable to receive a test probe to permit contacting the test probe with the electrical terminal without requiring removal of the cover from the electrical terminal.

32. The apparatus of claim 27 wherein said wall portions and said rigid guide wall are embodied in a unitary piece of insulating material.

33. The apparatus of claim 32 wherein said insulating material comprises plastic.

34. The apparatus of claim 27 wherein at least one of said wall portions is curved and is configured to extend over said top portion of the electrical terminal.

35. The apparatus of claim 34 wherein at least one of said wall portions is curved and is positioned opposite said at least one of said wall portions having a conductor opening.

36. The apparatus of claim 35 wherein said wall portion extending over said top portion of the electrical terminal and said wall portion positioned opposite said at least one of said wall portions having a conductor opening are joined by an angled wall portion.

37. The apparatus of claim 27 wherein said wall portions configured to extend about a perimeter the electrical terminal have edges that lie in a common plane.

38. The apparatus of claim 37, wherein said rigid guide wall is generally U-shaped and has first and second leg portions having edges lying in said common plane.

39. The apparatus of claim 38 wherein said rigid guide wall includes a curved joining portion joining the first and second leg portions, the curved joining portion having a radius of curvature becoming progressively larger progressively farther away from said housing.

* * * * *